US008690076B2

(12) United States Patent
Yamasaki et al.

(10) Patent No.: US 8,690,076 B2
(45) Date of Patent: Apr. 8, 2014

(54) ROTARY ATOMIZER HEAD, ROTARY ATOMIZER PAINTING DEVICE, ROTARY ATOMIZATION PAINTING METHOD

(75) Inventors: Isamu Yamasaki, Toyota (JP); Michio Mitsui, Yokohama (JP); Toshio Hosoda, Kanagawa-ken (JP)

(73) Assignees: Toyota Jidosha Kabushiki Kaisha, Toyota-shi, Aichi-ken (JP); Ransburg Industrial Finishing K.K., Yokohama, Kanagawa-ken (JP)

( * ) Notice: Subject to any disclaimer, the term of this patent is extended or adjusted under 35 U.S.C. 154(b) by 262 days.

(21) Appl. No.: 12/483,514

(22) Filed: Jun. 12, 2009

(65) Prior Publication Data

US 2009/0308949 A1 Dec. 17, 2009

(30) Foreign Application Priority Data

Jun. 12, 2008 (JP) ..... 2008-154542

(51) Int. Cl.
*B05B 3/10* (2006.01)

(52) U.S. Cl.
USPC ..... 239/223; 239/222.11; 239/224

(58) Field of Classification Search
USPC ..... 239/700–703, 222.11, 223, 224
See application file for complete search history.

(56) References Cited

U.S. PATENT DOCUMENTS

| | | | | |
|---|---|---|---|---|
| 4,458,844 | A * | 7/1984 | Mitsui | 239/703 |
| 5,909,849 | A * | 6/1999 | Yamasaki et al. | 239/700 |
| 5,934,574 | A * | 8/1999 | van der Steur | 239/690.1 |
| 6,029,905 | A * | 2/2000 | van der Steur | 239/222.11 |
| 6,557,781 | B2 * | 5/2003 | Kon | 239/224 |
| 6,811,094 | B2 * | 11/2004 | Kon et al. | 239/223 |
| 7,726,586 | B2 * | 6/2010 | Murai et al. | 239/224 |
| 7,861,945 | B2 * | 1/2011 | Yasuda et al. | 239/112 |

FOREIGN PATENT DOCUMENTS

| | | | |
|---|---|---|---|
| JP | 6-12836 | | 4/1994 |
| JP | 2007-7506 | | 1/2007 |
| WO | WO2006/049341 | * | 5/2006 |

* cited by examiner

*Primary Examiner* — Jason Boeckmann
(74) *Attorney, Agent, or Firm* — Finnegan, Henderson, Farabow, Garrett & Dunner, LLP

(57) ABSTRACT

An annular dam portion is formed along a circumference of an inner peripheral face of a rotary atomizer head and has a plurality of paint supply holes formed along the circumferential direction at the boundary between the annular dam portion and the inner peripheral face. The annular dam portion is disposed between the bottom of the inner peripheral face and the tip of the inner peripheral face. The dam portion is formed such that a substantially constant distance separates the inner peripheral face from the dam portion.

9 Claims, 10 Drawing Sheets

ROTARY ATOMIZER HEAD, ROTARY ATOMIZER PAINTING DEVICE, ROTARY ATOMIZATION PAINTING METHOD

INCORPORATION BY REFERENCE

The disclosure of Japanese Patent Application No. 2008-154542 filed on Jun. 12, 2008 including the specification, drawings and abstract is incorporated herein by reference in its entirety.

BACKGROUND OF THE INVENTION

1. Field of the Invention

The invention relates to a rotary atomizer head, a rotary-atomizer painting device, and a rotary atomization painting method of electrostatic painting.

2. Description of the Related Art

A conventional rotary atomizer painting device is generally constructed such that a rotary atomizer head, equipped with an inner peripheral face that increases in diameter from the bottom thereof toward the tip thereof, is rotatably fitted to a painting device body and is rotated at high speed to apply a centrifugal force to a paint supplied to the bottom of the inner peripheral face to atomize and discharge the paint.

In the rotary-atomizer painting device, a high electrostatic voltage is applied to the rotary atomizer head to charge fine particles of the atomized paint. The charged particles of the paint are splattered toward a grounded object to be painted through an electrostatic electric field formed between the rotary atomizer head and the object to be painted. The surface of the object to be painted is thereby painted. As the rotary atomization painting device thus constructed, there is a painting device described in, for example, Japanese Utility Model Publication No. 6-12836 (JP-U-6-12836).

Further, as shown in FIGS. 9 and 10, a rotary atomizer head 101 that the described rotary atomization painting device is equipped with has an inner peripheral face 102 that increases in diameter from a bottom toward a tip thereof. The inner peripheral face 102 increases in diameter from the bottom 121 thereof toward the tip thereof (the near side of the sheet of FIG. 9, the left side of FIG. 10). Further, a paint discharge end 102*c* is formed at the tip of the inner peripheral face 102, and a dam portion 104 is formed on the inner peripheral face 102 between the bottom portion 121 and the paint discharge end 102*c*.

The dam portion 104 is formed along the circumferential direction of the inner peripheral face 102, and is constructed as an annular member that extends from the inner peripheral face 102 substantially perpendicular to a rotary shaft. An opening 104*b* is provided in a central portion of the dam portion 104. Further, a region of the inner peripheral face 102 located between the bottom 121 and the dam portion 104 constitutes an inner paint channel 102*a*, and a region of the inner peripheral face 102 located between the tip and the dam portion 104 constitutes an outer paint channel 102*b*.

Furthermore, a space surrounded by the dam portion 104 and the inner paint channel 102*a* constitutes a paint reservoir 122, in which a paint is held after being supplied from the bottom 121 and flowing to the tip side. Further, a plurality of paint supply holes 104*a* are formed in a circumferential direction of the inner peripheral face 102 along the boundary between the dam portion 104 and the inner peripheral face 102. The inner paint channel 102*a* and the outer paint channel 102*b* communicate with each other through the paint supply holes 104*a*.

However, a communication hole 103 through which the bottom 121 and a base side of the rotary atomizer head 101 communicate with each other is formed through the bottom 121 of the inner peripheral face 102 of the rotary atomizer head 101 coaxially with the rotary shaft. A paint supply pipe 110 is inserted in the communication hole 103 from the base side of the rotary atomizer head 101. The paint supply pipe 110 has a closed tip. The tip of the paint supply pipe 110 protrudes from the bottom 121 of the inner peripheral face 102.

Further, a plurality of nozzle holes 110*a* are formed through a lateral face of the portion of the paint supply pipe 110 that protrudes from the bottom 121, which constitutes a paint supply nozzle 111.

When carrying out electrostatic painting with the rotary atomizer head 101 constructed as described above, the paint is supplied to the bottom 121 from the paint supply nozzle 111 when the rotary atomizer head 101 rotates at high speed. Then, the paint supplied to the bottom 121 flows toward the tip in the direction indicated by arrows A in FIG. 10 through the inner paint channel 102*a*, due to a centrifugal force created through rotation of the rotary atomizer head 101. The paint that has flowed from the bottom 121 to the tip through the inner paint channel 102*a* reaches the region in which the dam portion 104 is formed, where it is dammed by the dam portion 104, and is held in the paint reservoir 122.

The paint held in the paint reservoir 122 flows through the paint supply holes 104*a* out to the outer paint channel 102*b* in the direction indicated by arrows B, and is then atomized and discharged at the paint discharge end 102*c* of the inner peripheral face 102 in a direction indicated by arrows C.

As described above, in the rotary atomization painting device having the dam portion 104 formed on the inner peripheral face 102 of the rotary atomizer head 101, the paint reservoir 122, in which the paint is stored after being supplied to the bottom 121 and flowing to the tip side, is constructed.

Thus, if a large amount of paint is held in the paint reservoir 122 when the rotary atomizer painting device is turned OFF, it takes a long time to discharge all of the paint even after the rotary atomizer painting device has been turned OFF. More specifically, after the rotary atomizer painting device has been turned OFF, it takes several seconds for all the paint held in the paint reservoir 122 to be discharged. Therefore, the paint is not fluid enough. Further, an increase in operation time and a decrease in painting efficiency are caused due to the aforementioned construction. Moreover, if the painting device is turned off in an emergency, the paint in the paint reservoir 122 may drip, which may degrade the quality of the paint finish.

SUMMARY OF THE INVENTION

The invention provides a rotary atomizer head and a rotary atomization painting device that ensure an increase in painting efficiency and a reduction in operation time through the improvement of the fluidity of a paint in a painting OFF state, and do not cause any finish failure such as the dripping of the paint or the like even when the painting device is stopped in an emergency.

A first aspect of the invention relates to a rotary atomizer head that atomizes and discharges paint. This rotary atomizer head is equipped with: an inner peripheral face that increases in diameter from a bottom toward a tip thereof; a dam portion, having an annular shape, that is formed along a circumference of the inner peripheral face between the bottom and the tip of the inner peripheral face; and a paint supply port provided through the bottom of the inner peripheral face to supply the paint. The paint supplied from the paint supply port to the bottom of the inner peripheral face is caused to flow to the tip along the inner peripheral face due to a centrifugal force created by a rotation of the rotary atomizer head, and is atomized and discharged from the tip of the inner peripheral face. A plurality of paint supply holes are formed through the dam portion in a circumferential direction near a boundary between the dam portion and the inner peripheral face. The inner peripheral face faces the bottom of the dam portion. The inner peripheral face and the bottom face of the dam portion are separated from each other by a predetermined distance.

A second aspect of the invention relates to a rotary atomization painting device. This rotary atomization painting device is equipped with a rotary atomizer head equipped with: an inner peripheral face that increases in diameter from a bottom toward a tip thereof, and a paint supply port provided through the bottom of the inner peripheral face to supply paint. The paint supplied from the paint supply port to the bottom of the inner peripheral face is directed to flow toward the tip along the inner peripheral face due to a centrifugal force, and is thereby atomized and discharged by the tip of the inner peripheral face. A dam portion is formed between the bottom of the inner peripheral face and the tip of the inner peripheral face, wherein the dam portion is annularly formed along a circumference of the inner peripheral face and has a plurality of paint supply holes formed therethrough in a circumferential direction near a boundary between the dam portion and the inner peripheral face. The dam portion is formed with that region of the inner peripheral face opposite the dam portion and the face of the dam portion opposite the inner peripheral face are separated from each other by a predetermined distance.

A third aspect of the invention relates to a rotary atomization painting method for spraying a paint using the rotary atomizer head according to the foregoing aspect of the invention.

According to the invention, a rise in painting efficiency and a reduction in operation time can be achieved through the improvement of the fluidity of the paint in the painting OFF state, and the occurrence of a finish failure such as the dripping of the paint or the like can be prevented even when the painting device is stopped in an emergency.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Next, the first to fifth embodiments of the invention will be described with reference to the drawings. The technical scope of the invention is not limited to the following embodiments thereof, but widely extends over an entire range, of a technical concept truly intended by the invention as is apparent from what is described in the present specification and the drawings.

The rotary atomizer head and the rotary-atomizer painting device according to the embodiments of the invention will be described hereinafter.

Figure 1:
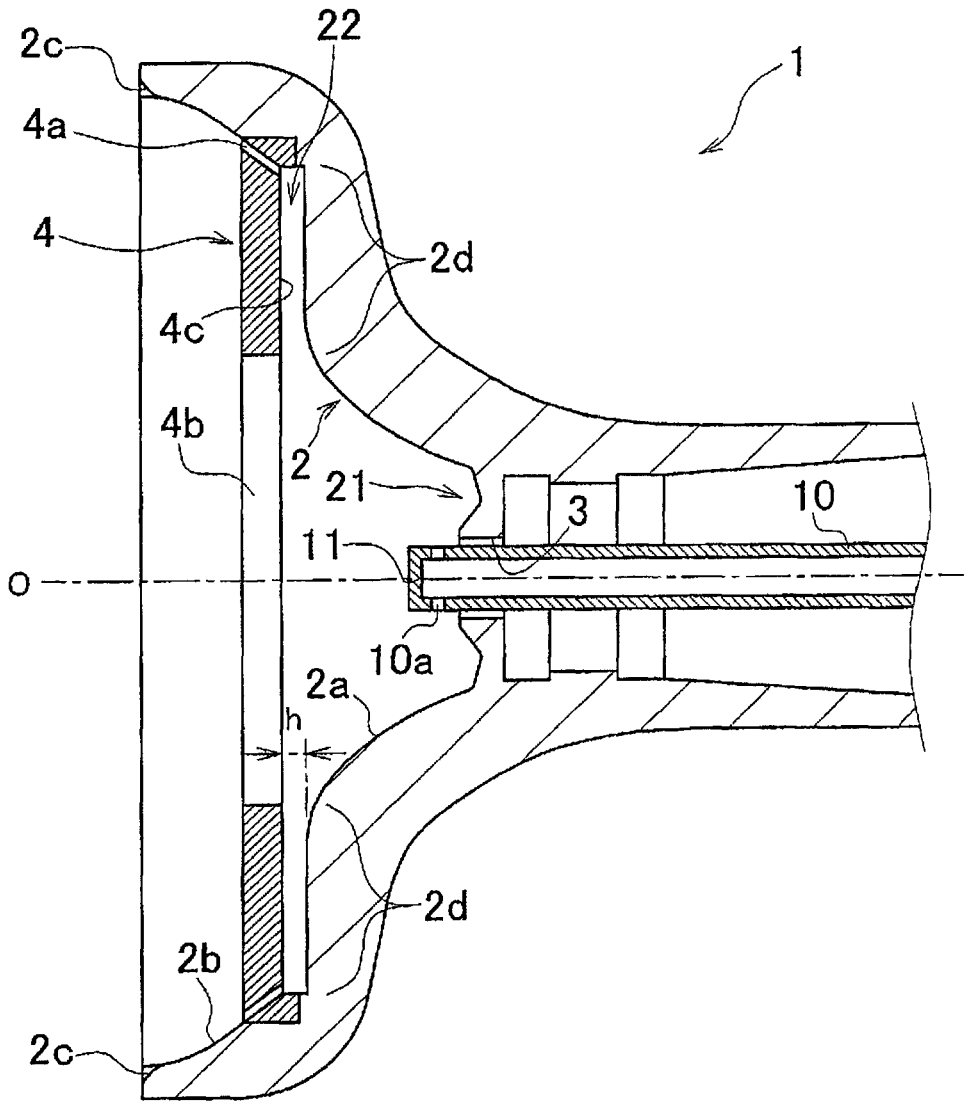
FIG. 1 is a lateral cross-sectional view showing a rotary atomizer head according to a first embodiment of the invention.

As shown in FIG. 1, a rotary atomizer head 1 according to the first embodiment of the invention is installed in a rotary-atomizer painting device for electrostatic painting, and the base of the rotary atomizer head 1 is fitted to a painting device body (not shown) of the rotary-atomizer painting device on a rotary shaft O. The rotary atomizer head 1 has an inner peripheral face 2 that increases in diameter from a bottom 21 thereof toward a tip side thereof (the left end side in FIG. 1), and a paint discharge end 2*c* is formed at the tip of the inner peripheral face 2. The right side of the rotary atomizer head 1 according to this embodiment, as shown in FIG. 1, is the base side and that the left side of the rotary atomizer head 1 is the tip side.

A communication hole 3, through which the bottom 21 and the base side of the rotary atomizer head 1 communicate with each other, is formed through the bottom 21 of the inner peripheral face 2 of the rotary atomizer head 1 coaxially with the rotary shaft O. A paint supply pipe 10 is inserted through the communication hole 3 from the base side of the rotary atomizer head 1. The paint supply pipe 10 is formed with a closed tip that protrudes from the bottom 21 of the inner peripheral face 2.

A plurality of nozzle holes 10*a* are formed through a lateral face of the portion of the paint supply pipe 10 that protrudes from the bottom 21, and a paint supply nozzle 11 is constituted by that region of the paint supply pipe 10 that protrudes from the bottom 21. The base of the paint supply pipe 10 is connected to the painting device body, and paint in a paint tank fitted to the painting device body is supplied to the paint supply nozzle 11 through the paint supply pipe 10 and then discharged to the bottom 21 of the inner peripheral face 2 through the nozzle holes 10*a* of the paint supply nozzle 11.

The paint discharged from the nozzle holes 10*a* flows radially outward from the central portion of the bottom 21 and reaches the inner peripheral face 2.

A dam portion 4 is formed between the bottom 21 of the inner peripheral face 2 and the paint discharge end 2*c*. The dam portion 4 is formed along the circumferential direction of the inner peripheral face 2, and is constructed as an annular member that extends from the inner peripheral face 2 substantially perpendicularly to the rotary shaft O. An opening 4*b* is formed through a central portion of the dam portion 4. Further, the portion of the inner peripheral face 2 that is located between the bottom 21 and the dam portion 4 constitutes an inner paint channel 2*a*, and the region of the inner peripheral face 2 that is located between the tip and the dam portion 4 constitutes an outer paint channel 2*b*.

It should be noted herein that a dam formation portion 2*d* of the inner peripheral face 2, which faces the dam portion 4, and a face 4*c* of the dam portion 4 that faces the dam formation portion 2*d* of the inner peripheral face 2 are separated from each other by a small distance. That is, while the dam portion 4 is formed on a face perpendicular to the rotary shaft O, the inner paint channel 2*a* is formed along a curve from the bottom 21 toward the tip side such that a face substantially perpendicular to the rotary shaft O is formed by the dam formation portion 2*d*. In other words, the inner paint channel 2*a* is convexly curved toward the tip side, and the inner peripheral face 2 is formed such that the width h of a space between the dam portion 4 and the dam formation portion 2*d* is substantially constant.

As described above, the space between the dam portion 4 and the dam formation portion 2*d* is constituted as a paint reservoir 22 in which the paint is held after being supplied to the bottom 21 and flowing to the tip side. Further, a plurality of paint supply holes 4*a* are formed at regular intervals in the circumferential direction at the boundary between the dam portion 4 and the inner peripheral face 2. The paint supply holes 4*a* are extended from a boundary between the dam portion and the inner peripheral face toward the tip of the rotary atomizer head, thereby the inner paint channel 2*a* and the outer paint channel 2*b* communicate with each other through the paint supply holes 4*a*.

In the rotary atomizer head 1 constructed as described above, when the bottom 21 is supplied with the paint from the paint supply nozzle 11 and the rotary atomizer head 1 is rotating at high speed at the time of painting, the paint supplied to the bottom 21 flows to the tip side through the inner paint channel 2*a* due to a centrifugal force created through rotation of the rotary atomizer head 1. The paint that has flowed from the bottom 21 to the tip side through the inner paint channel 2*a* reaches the region where the dam portion 4 is formed, is stopped by the dam portion 4, and is held in the paint reservoir 22.

Figure 2A:
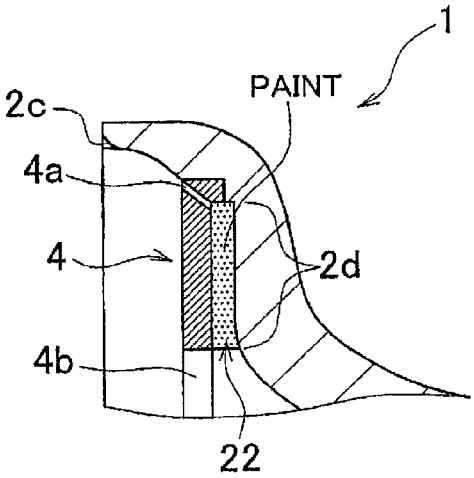
FIG. 2A is a lateral cross-sectional view showing a dam portion formation region when paint is held behind a dam portion of a rotary atomizer head according to the first embodiment.
Figure 2B:
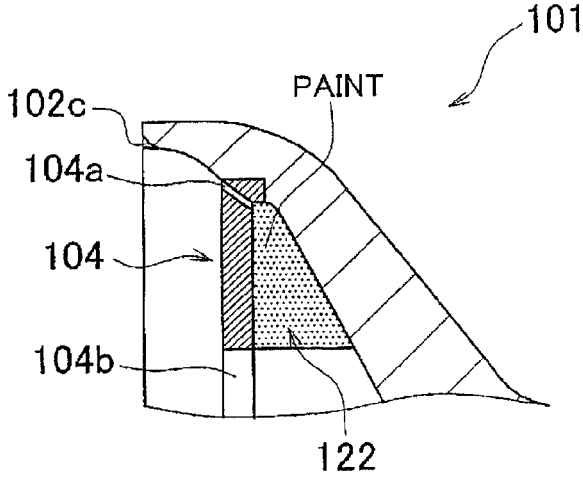
FIG. 2B RELATED ART
FIG. 2B is a lateral cross-sectional view showing the dam portion formation region when paint is held behind the dam portion of a conventional rotary atomizer head.

It should be noted herein that when paint is held in the dam portion 4 of the rotary atomizer head 1, the volume of the stored paint may be reduced as shown in FIG. 2A in comparison to when the paint is held in the dam portion 104 of a conventional rotary atomizer head 101 shown in FIG. 2B. That is, in the rotary atomizer head 1 according to this embodiment of the invention, the dam formation portion 2*d* of the inner peripheral face 2 which faces the dam portion 4 and the face 4*c* of the dam portion 4 on the bottom side are formed contiguously to each other. Therefore, the volume of the paint reservoir 22 is smaller than the volume of the paint reservoir 122 of a conventional rotary atomizer head 101 whose inner peripheral face is formed on an incline that is substantially rectilinear in a cross-sectional view.

As described above, the paint held in the paint reservoir 22 flows out to the outer paint channel 2*b* through the paint supply holes 4*a* and then is discharged from the paint discharge end 2*c* of the inner peripheral face 2. A large number of serrations (groove portions) are formed at the paint discharge end 2*c* in a direction in which the paint flows out. When the paint that has flowed through the outer paint channel 2*b* flows past the paint discharge end 2*c*, the discharged paint becomes threads in liquid form and then is atomized after being discharged. Thus, the paint is sprayed by the rotary atomizer head 1.

Accordingly, even if a shift between a paint ON state and a paint OFF state is required at the time of painting, the fluidity of the paint in the painting OFF state can be improved. That is, even if it is necessary to turn off the rotary-atomizer painting device, the amount of the paint held in the paint reservoir 22 is small. Therefore, all of the paint may be discharged quickly (in less than about one second). Further, due to this construction, painting efficiency is increased and operation time may be reduced by reducing the loss of time in the painting OFF state. Moreover, the occurrence of paint finish defects such as the dripping of the paint or the like may be prevented, for example, even if the painting device is stopped in an emergency.

Figure 3A:
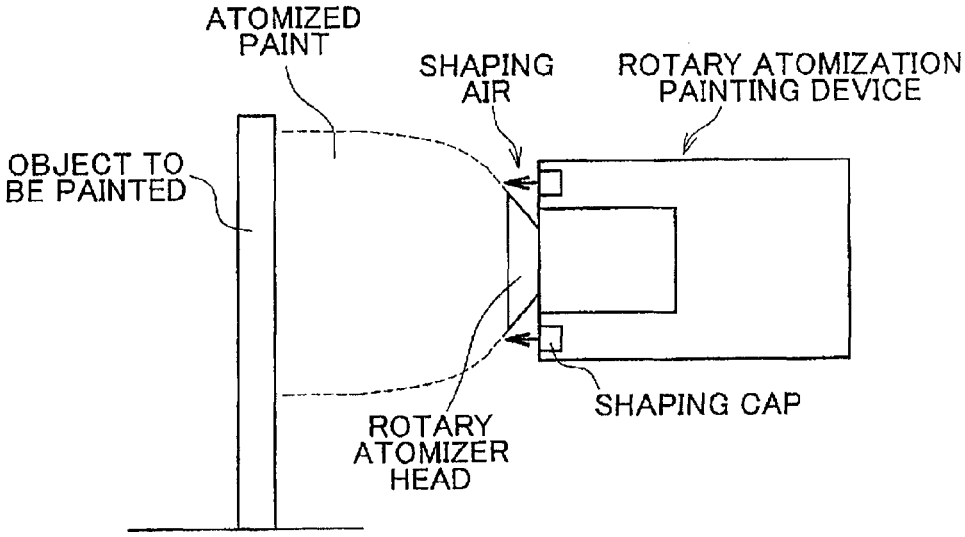
FIG. 3A is a schematic view showing a method of rotary atomization painting.

Next, a painting method by the rotary atomizer head according to this embodiment of the invention will be described using FIGS. 3A to 3C. As shown in FIG. 3A, in the rotary-atomizer painting device, the atomized paint is discharged from the tip of the rotary atomizer head. It should be noted herein that because the centrifugal force resulting from rotation of the rotary atomizer head acts on the atomized paint, a large amount of shaping air is emitted from a shaping cap disposed in the rotary atomization painting device, and particles of the paint are moved toward the object to be painted by the shaping air.

Figure 3B:
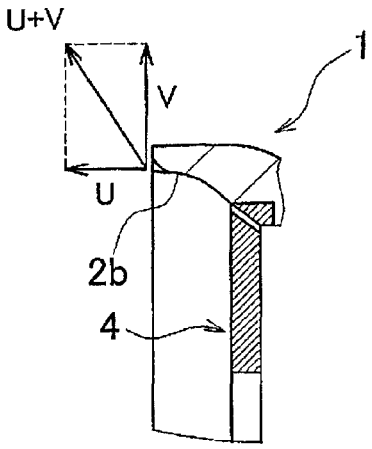
FIG. 3B is a lateral cross-sectional view showing the tip of the rotary atomizer head according to the first embodiment of the invention.
Figure 3C:
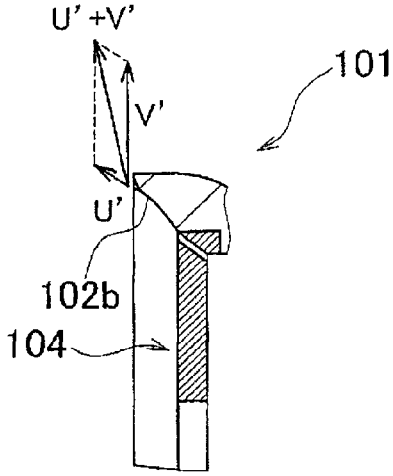
FIG. 3C RELATED ART
FIG. 3C is a lateral cross-sectional view showing the tip of a conventional rotary atomizer head.

It should be noted herein that because the conventional outer paint channel 102*b* is inclined radially outward in the rotary atomizer head 101 as shown in FIG. 3C, an injection speed U' forms a small angle with a speed V' in the direction of a centrifugal force. That is, the speed of the atomized paint moving toward the object to be painted is low. Therefore, a resultant speed V'+U' of the speed V' in the direction of the centrifugal force and the injection speed U' is greatly oriented radially outward. Thus, in order to cause the atomized paint to move toward the object to be painted, a large amount of shaping air is required at the time of painting. Further, even when a dam-type rotary atomizer head is used to increase the injection speed U', the angle formed between the direction of the centrifugal force and the direction of injection remains unchanged. Therefore, the speed component in the direction toward the object to be painted cannot be efficiently increased.

In the rotary atomizer head 1 according to this embodiment of the invention, as shown in FIG. 3B, the outer paint channel 2*b* is inclined at a small angle in the direction of the rotary shaft, and extends in the same direction as that of the rotary shaft. Thus, the direction of the injection speed U is oriented toward the object to be painted, and the angle formed by the injection speed U with the speed V in the direction of the centrifugal force is thereby increased. That is, the speed of the atomized paint toward the object to be painted is increased, and the resultant speed V+U of the speed V in the direction of the centrifugal force and the injection speed U is oriented toward the object to be painted. That is, in this embodiment of the invention, the speed toward the object to be painted may further be increased by increasing the injection speed U using the dam-type rotary atomizer head. In addition, this construction reduces the amount of shaping air needed to move the paint particles toward the object to be painted, The outer paint channel 2*b* may be parallel to the rotary shaft of the rotary atomizer head 1 (i.e., inclined substantially by 0°) or slightly inclined with respect to the rotary shaft.

Next, a rotary atomizer head 41 according to the second embodiment of the invention will be described with reference to FIG. 4. Components of the rotary atomizer head according to the embodiments of the invention described below that are common with those of the first embodiment are denoted using the same reference symbols and will not be described below.

Figure 4:
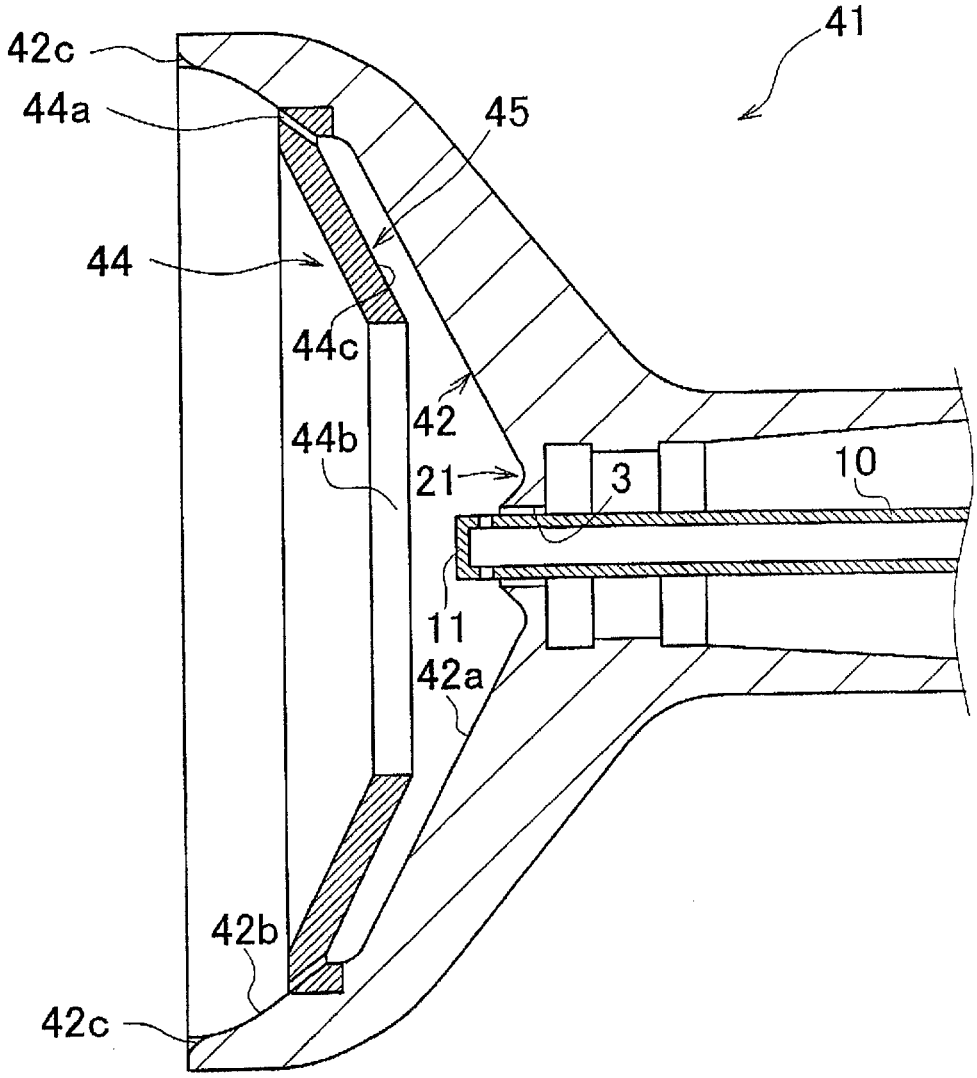
FIG. 4 is a lateral cross-sectional view showing a rotary atomizer head according to a second embodiment of the invention.

As shown in FIG. 4, the rotary atomizer head 41 according to this embodiment of the invention is installed in a rotary atomization painting device that carries out electrostatic painting for an object to be painted in the same manner as in the first embodiment of the invention. An inner peripheral face 42 increases in diameter from the bottom 21 toward the tip side thereof is formed on the rotary atomizer head 41, and a paint discharge end 42*c* is formed at the tip of the inner peripheral face 42.

Further, the inner peripheral face 42 is formed on a generally conical tapered face, and a dam portion 44 is formed between the bottom 21 and the paint discharge end 42*c* of the inner peripheral face 42. The region of the inner peripheral face 42 that is located between the bottom 21 and the dam portion 44 constitutes a inner paint channel 42*a*, and the region of the inner peripheral face 42 that is located between the tip and the dam portion 44 constitutes an outer paint channel 42*b*.

It should be noted that the inner peripheral face 42 faces the bottom face of the dam portion 44, and the inner peripheral face 42 and the dam portion 44 are separated from each other by a small distance. More specifically, the dam portion 44 is inclined at the same angle as the inner peripheral face 42 in the direction of the rotary shaft from the tip side of the inner peripheral face 42 toward the bottom side of the inner peripheral face 42. In other words, the dam portion 44 is formed so that an inner peripheral region of the dam portion 44, which has an opening 44*b* formed through a central portion thereof, projects toward the bottom side of the inner peripheral face 42, and is secured to the inner peripheral face 42.

It should be noted herein that a space between the dam portion 44 and the inner peripheral face 42 forms a paint reservoir 45 in which paint is held after being supplied to the bottom 21 and flowing to the tip side. Further, a plurality of paint supply holes 44*a* are formed in a circumferential direction through a boundary portion between the dam portion 44 and the inner peripheral face 42. The inner paint channel 42*a* communicates with the outer tip paint channel 42*b* through the paint supply holes 44*a*.

In the rotary atomizer head 41 constructed as described above, the region of the inner peripheral face 42 that faces the dam portion 44 and the face 44*c* of the dam portion 44, which faces the inner peripheral face 42, are separated from each other by a small distance. Therefore, as is the case with the first embodiment of the invention, the volume of the paint reservoir 45 is minimized.

Due to the above construction, even when a shift from a painting ON state to a painting OFF state is made in the rotary atomization painting device, the amount of paint held in the paint reservoir 45 is small. Therefore, all of the paint may be discharged quickly (e.g., in less than about one second). In addition, painting efficiency is increased and the operation time may be reduced by reducing the loss of time in the painting OFF state. Moreover, the occurrence of paint finish defects such as the dripping of the paint or the like may be prevented, for example, even if the painting device is stopped in an emergency.

Figure 5:
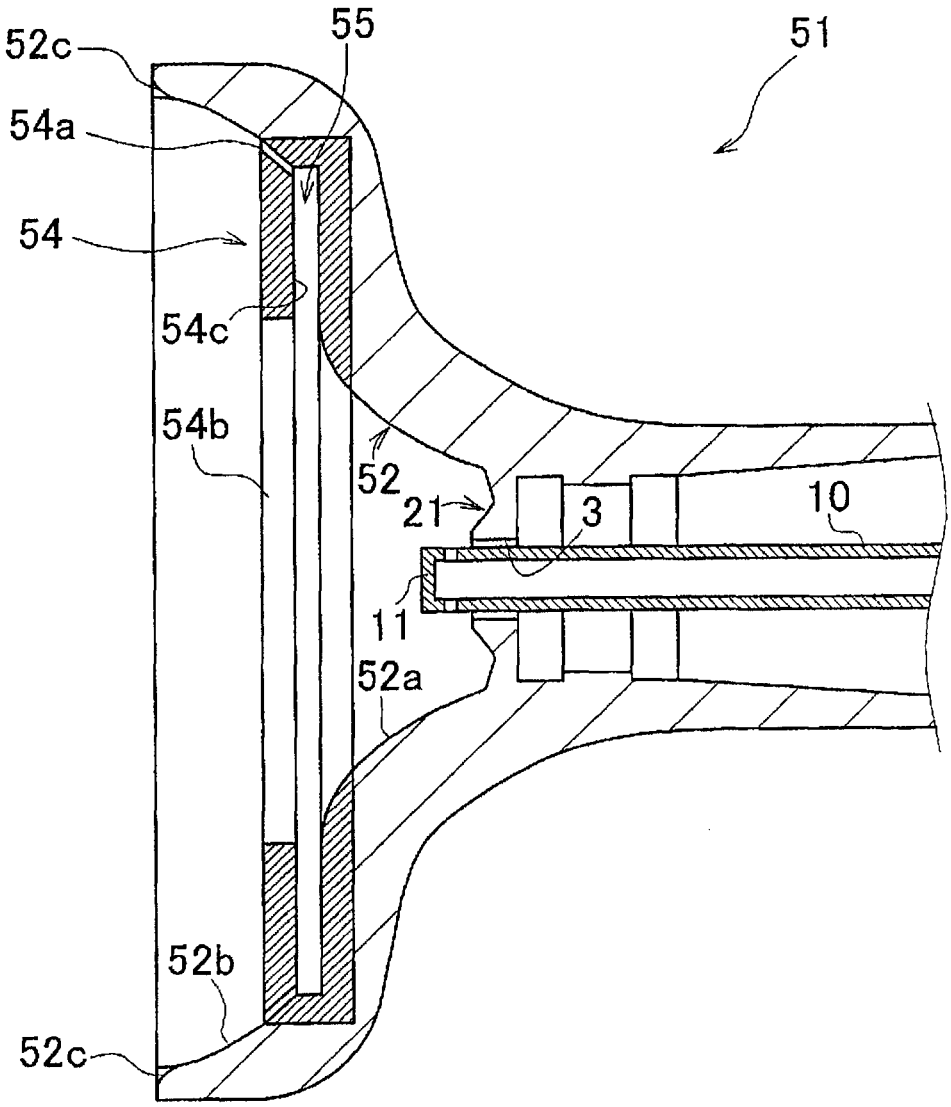
FIG. 5 is a lateral cross-sectional view showing a rotary atomizer head according to a third embodiment of the invention.

Next, a rotary atomizer head 51 according to a third embodiment of the invention will be described with reference to FIG. 5. As shown in FIG. 5, in addition to the construction of the foregoing first embodiment of the invention, the rotary atomizer head 51 according to this embodiment of the invention is formed such that the dam portion 54 is an annular plate member having a groove 54*c* formed on an inner periphery side thereof and a plurality of paint supply holes 54*a* formed in a circumferential direction on an outer peripheral end of the groove portion 54*c*. The dam portion 54 is secured to the inner peripheral face 52 of the rotary atomizer head 51. That is, the groove 54*c* has a groove depth extends radially outward from the inner periphery of the dam portion 54. The groove portion 54*c* thus constitutes a paint reservoir 55.

That is, while the paint reservoir 22 in the first embodiment of the invention is formed as a space between the dam portion 4 and the dam formation portion 2*d*, the paint reservoir 55 in this embodiment of the invention is integrated with the dam portion 54 by forming the groove 54*c* on the inner periphery side of the dam portion 54. The dam portion 54 is then secured to the inner peripheral face 52 to thereby constitute the rotary atomizer head 51.

With the above construction, the application of a load to a region between the dam portion 54 and the inner peripheral face 52, resulting from a fluid pressure of the paint generated through rotation of the rotary atomizer head 51, may be prevented. That is, even when a centrifugal force is applied to the paint held in the paint reservoir 55 and the load is applied to the paint reservoir 55, only the dam portion 54 is subjected to the load because of the integral construction of the dam portion 54. Thus, the load in the dam portion 54 is not transmitted to the inner peripheral face 52, and the darn portion 54 is not detached from the rotary atomizer head 51 toward the tip side.

Figure 6:
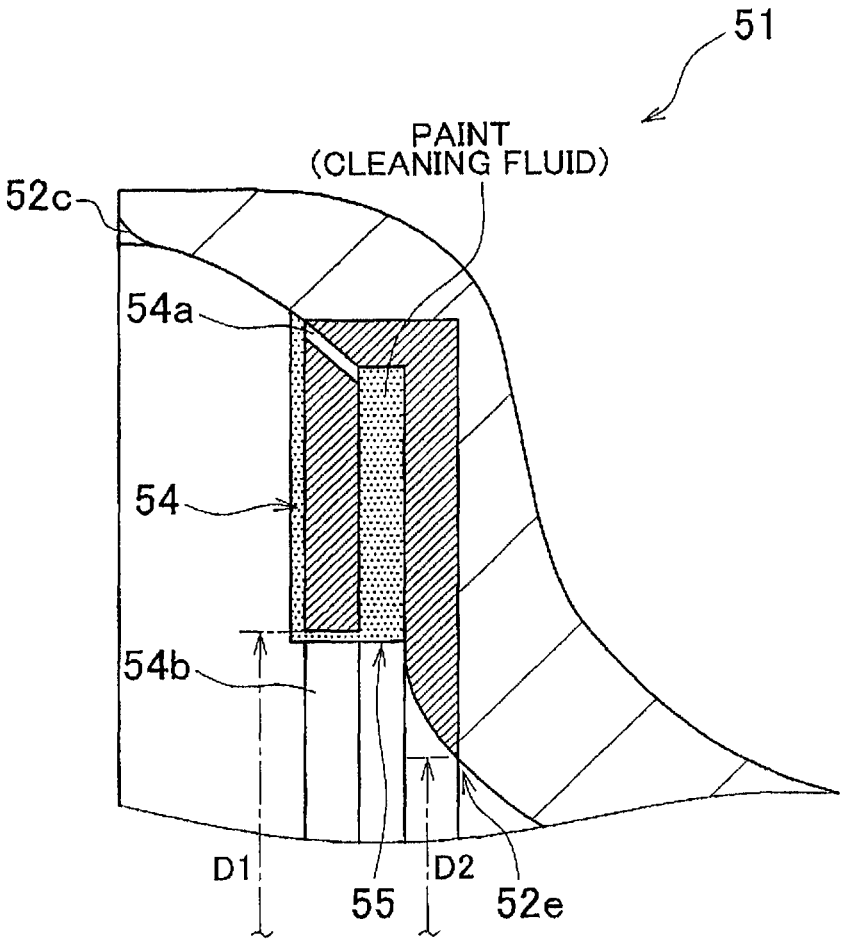
FIG. 6 is a lateral cross-sectional view showing a dam portion formation region at when paint is held behind the dam portion of the rotary atomizer head according to the third embodiment of the invention.

Furthermore, in this embodiment of the invention, as shown in FIG. 6, the dam portion 54 is formed such that an inner diameter D1 on the tip side thereof is larger than an inner diameter D2 on a bottom side thereof. Thus, the paint held in the paint reservoir 55 is prevented from contacting a mounting end 52*e*, where the dam portion 54 is mounted on the inner peripheral face 52. That is, even if the amount of the supplied paint increases, the paint flows out from the tip side of the dam portion 54 as shown in FIG. 6. Therefore, the paint to which a fluid pressure is applied does not reach the mounting end 52*e*.

With the above construction, even when a centrifugal force is applied to the paint held in the paint reservoir 55 through rotation of the rotary atomizer head 51 and a fluid pressure is generated, the paint to subjected to the fluid pressure does not contact the mounting end 52*e* where the dam portion 54 is mounted on the inner peripheral face 52. Therefore, the paint does not enter the mounting end 52*e* to apply a load to the dam portion 54.

Further, in cleaning the rotary atomizer head 51, a cleaning fluid supplied from the paint supply nozzle 11 to the bottom 21 is stored in the paint reservoir 55, and is caused to flow out from the tip side of the dam portion 54. In this case as well as the foregoing, the stored cleaning liquid flows to the tip side instead of reaching the mounting end 52*e*. Therefore, the pressurized cleaning fluid does not enter the mounting end 52*e* to apply a load to the dam portion 54.

Figure 7:
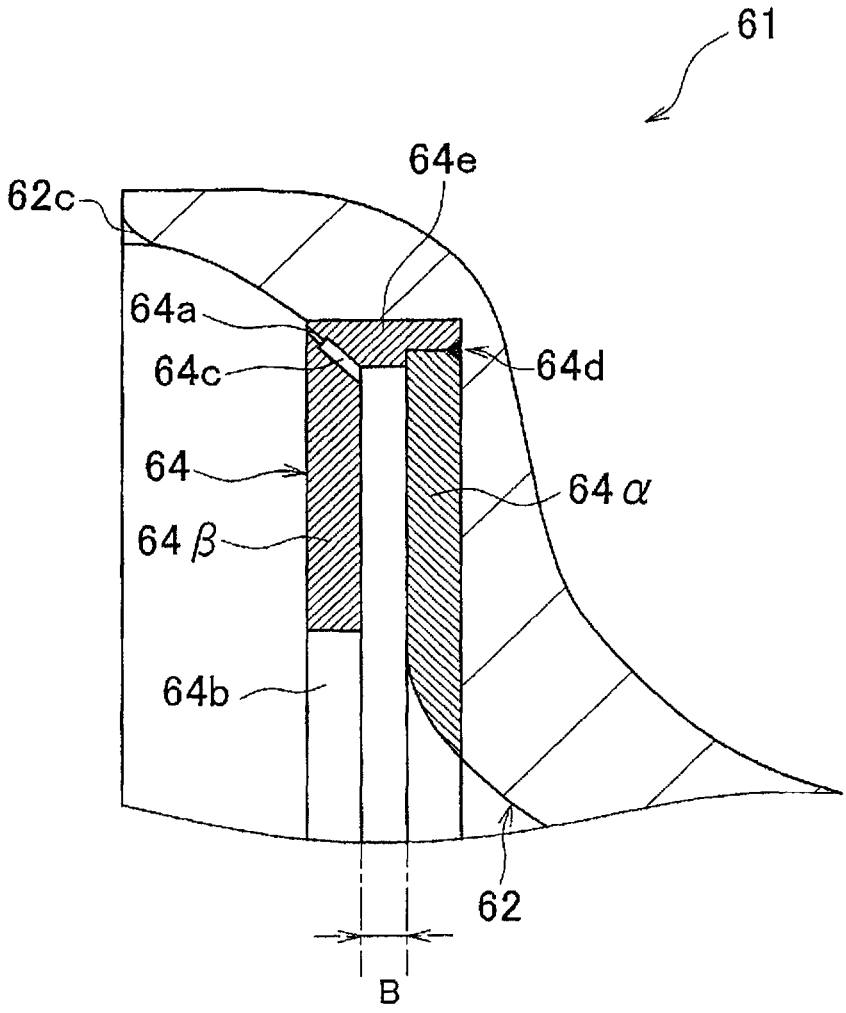
FIG. 7 is a lateral cross-sectional view showing a dam portion formation region of a rotary atomizer head according to a fourth embodiment of the invention.

Next, a rotary atomizer head 61 according to a fourth embodiment of the invention will be described with reference to FIG. 7. As shown in FIG. 7, in addition to the construction described in the foregoing third embodiment of the invention, in the rotary atomizer head 61 according to this embodiment of the invention, a dam portion 64 is formed as a two-piece structure in which an inner annular plate 64*a* is secured to the inner peripheral face 62 and an outer annular plate 64β, having a spacer 64*e* located at an outer peripheral end thereof, is joined to the inner annular plate 64*a* by an end face joint portion 64*d*. That is, the dam portion 64 is constructed by fitting the inner annular plate 64*a* to a recessed portion formed in the spacer 64*e* of the outer annular plate 64β, and the rotary atomizer head 61 is constructed by securing the dam portion 64 to the inner peripheral face 62.

With the above construction, forming a paint supply hole 64*a* may be easier. More specifically, a prepared hole 64*c* is worked through the outer annular plate 64β before fitting the inner annular plate 64*a*, and after that, the paint supply hole 64*a* is formed through a worked region of the prepared hole 64*c*. After that, the inner annular plate 64*a* is fitted to form the dam portion 64. Therefore, the operation for forming the paint supply hole 64*a* may be more easily performed than where the paint supply hole 64*a* is worked after integrally constructing the dam portion 64.

Further, the recessed portion is formed in the spacer 64, and the fitting of the inner annular plate 64*a* to the recessed portion is carried out. A dam width B of the dam portion 64 may thereby be set as appropriate, and the precision of joining can be enhanced. Furthermore, the strength of the dam portion 64 and the seal ability of the dam portion 64 may be ensured through end face joining by the end face joint portion 64*d*.

Figure 8:
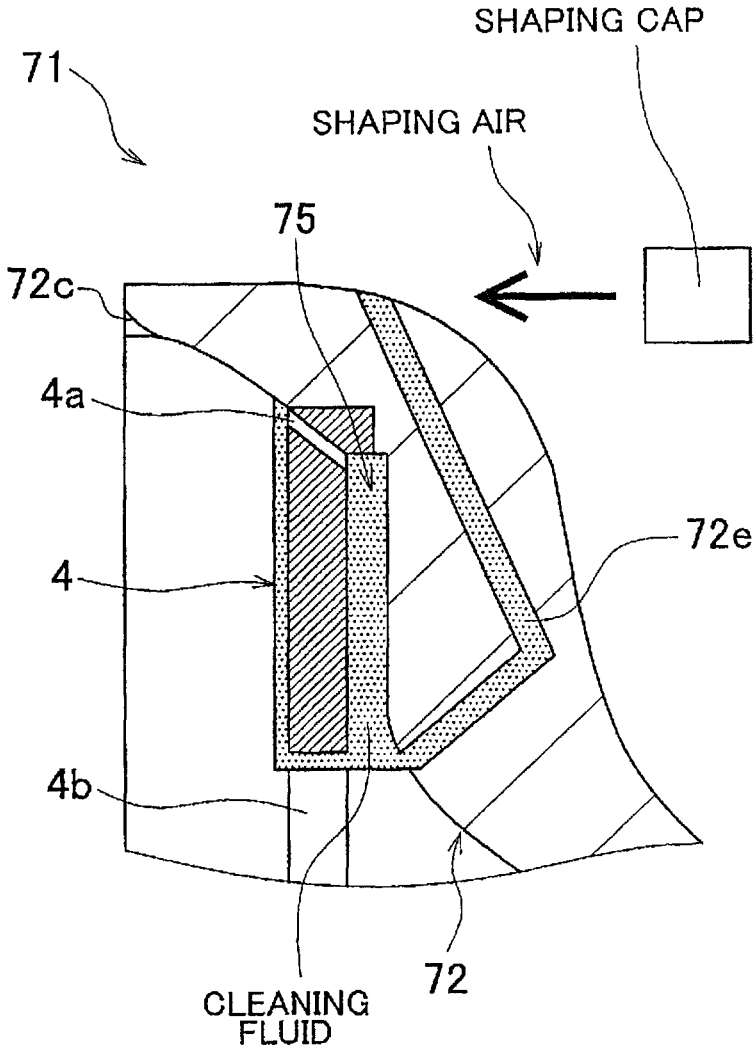
FIG. 8 is a lateral cross-sectional view showing a dam portion formation region of a rotary atomizer head according to a fifth embodiment of the invention when being cleaned.
Figure 9:
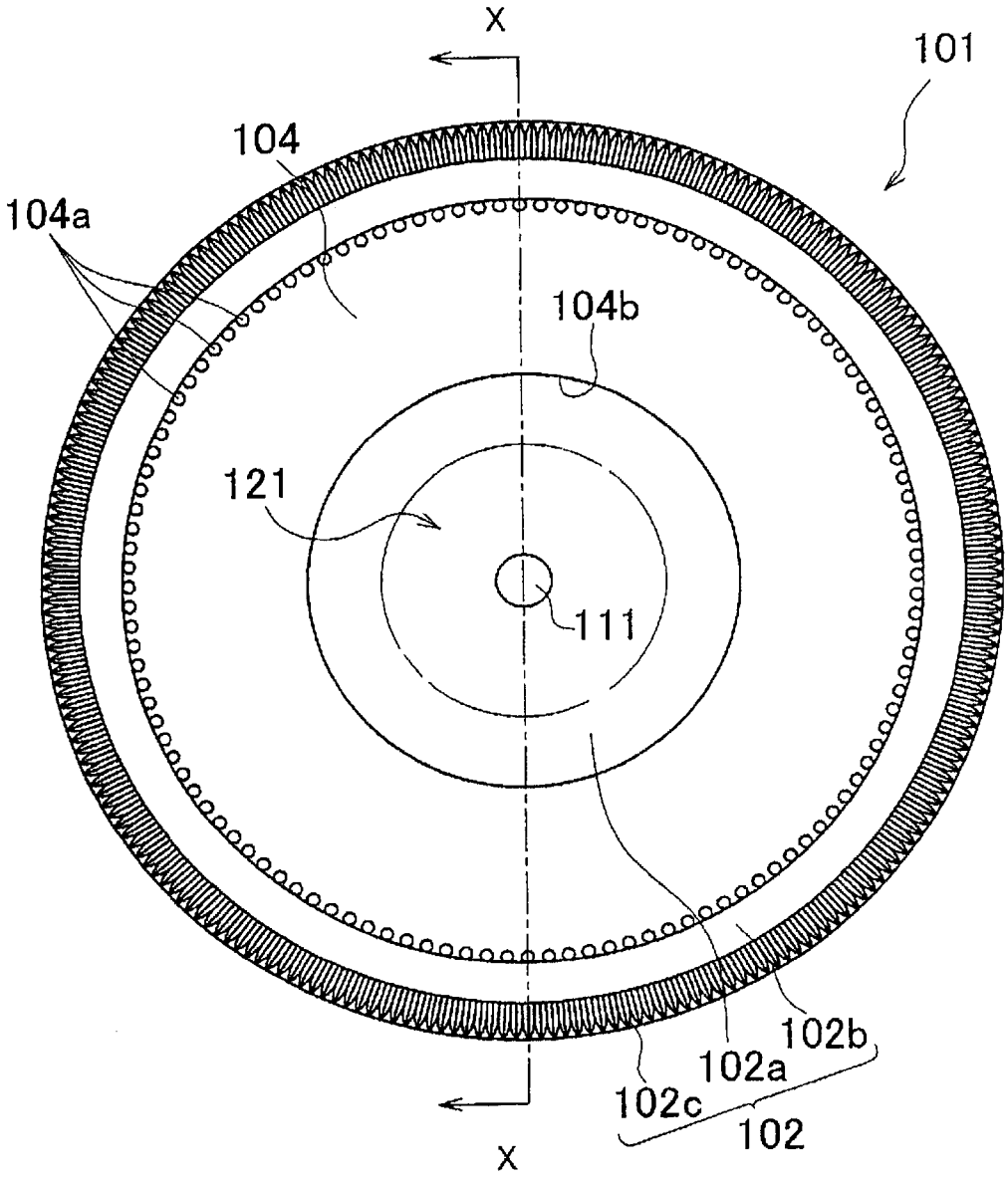
FIG. 9 RELATED ART
FIG. 9 is a front view showing a conventional rotary atomizer head.
Figure 10:
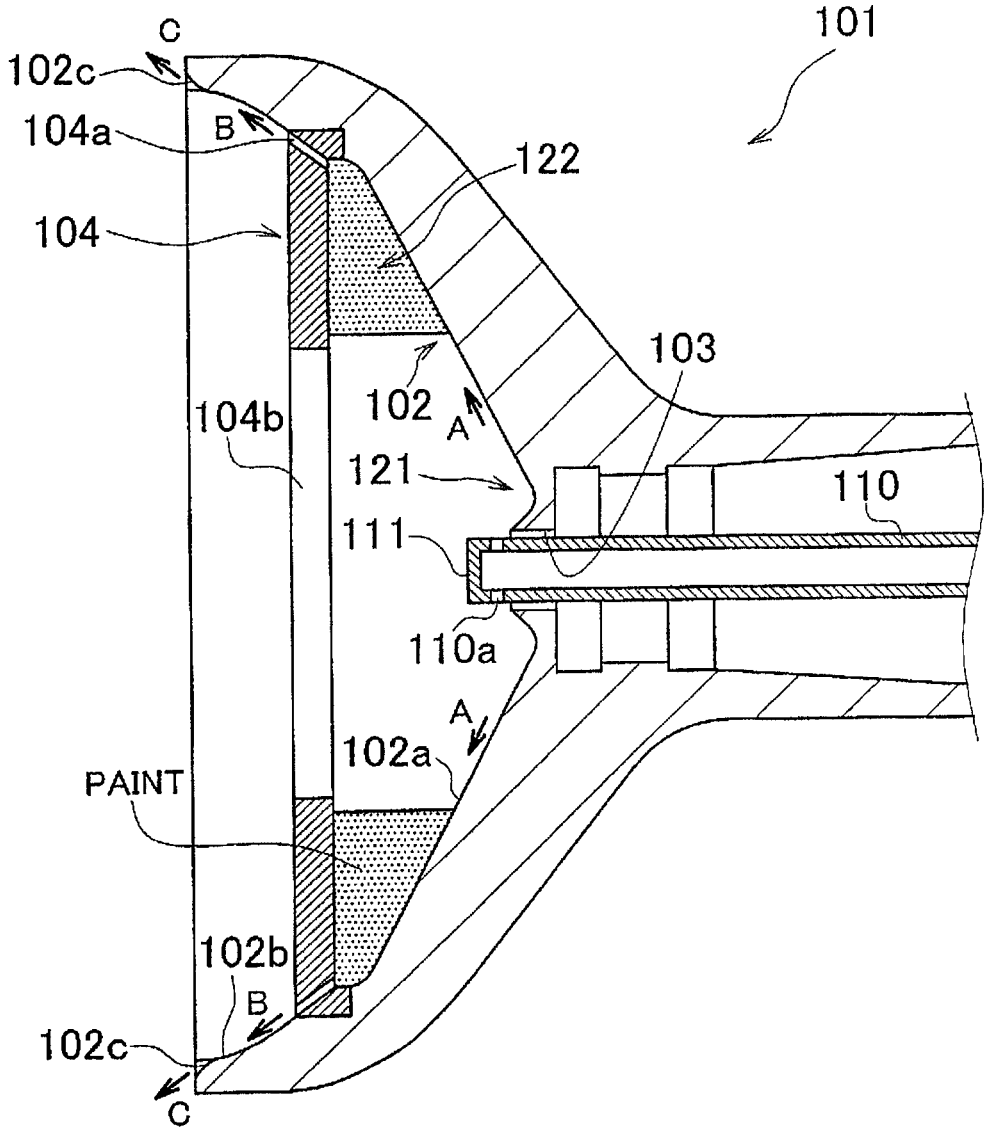
FIG. 10 RELATED ART
FIG. 10 is a lateral cross-sectional view taken along a line X-X in FIG. 9.

Next, a rotary atomizer head 71 according to the fifth embodiment of the invention will be described with reference to FIG. 8. As shown in FIG. 8, in addition to the construction described in the foregoing first embodiment of the invention, in the rotary atomizer head 71 according to this embodiment of the invention, a cleaning hole 72*e* communicating with the outside of the rotary atomizer head 71 is formed through that region of an inner peripheral face 72 that faces the vicinity of an inner diameter end of the dam portion 4. The cleaning hole 72*e* is only required to establish communication between the inner peripheral face 72 and the outside, and the shape of the cleaning hole 72*e* is not restricted to the particular shapes described in this embodiment of the invention.

With the above construction, when cleaning the atomizer head for the purpose of, for example, changing the color of paint supplied to the rotary atomizer head 71, a cleaning fluid supplied from the paint supply nozzle 11 to the bottom 21 is held in a paint reservoir 75. The rotary atomizer head 71 then rotates at high speed to apply a centrifugal force to the cleaning fluid and create a fluid pressure. Thus, the cleaning fluid held in the paint reservoir 75 flows out from the tip side of the dam portion 4 as shown in FIG. 8, and flows out to the outside from the cleaning hole 72*e* as well.

As described above, the cleaning fluid that has flowed out to the outside of the rotary atomizer head 71 through the cleaning hole 72*e* is pressed against the outer peripheral face of the rotary atomizer head 71 by shaping air emitted from a shaping cap. The outer peripheral face of the rotary atomizer head 71 may thereby be cleaned. That is, the outer peripheral face of the rotary atomizer head 71 may be cleaned without providing a separate cleaning device. Thus, the number of operation steps may be reduced.

What is claimed is:

1. A rotary atomizer head that atomizes and discharges paint, comprising:

an inner peripheral face that increases in diameter from a bottom toward a tip thereof;

a dam portion, having an annular shape, that is formed along a circumference of the inner peripheral face between the bottom and the tip of the inner peripheral face; and a paint supply port provided through the bottom of the inner peripheral face to supply the paint, the paint supply port being configured to supply paint in a radially outward direction directly to the bottom of the inner peripheral face, wherein:

the paint supplied from the paint supply port to the bottom of the inner peripheral face is directed to flow to the tip along the inner peripheral face due to a centrifugal force created by a rotation of the rotary atomizer head, and is atomized and discharged from the tip of the inner peripheral face;

a plurality of paint supply holes are formed through the dam portion near a boundary between the dam portion and the inner peripheral face;

a portion of the inner peripheral face faces a bottom face of the dam portion;

the portion of the inner peripheral face and the bottom face of the dam portion are separated from each other by a predetermined distance, defining a space configured to store the paint, the space being in flow communication with the paint supply port and the plurality of paint supply holes;

the bottom face of the dam portion is formed perpendicular to a rotary shaft of the rotary atomizer head;

the inner peripheral face is convexly curved from the bottom toward the tip thereof so that the portion of the inner peripheral face extends perpendicular to the rotary shaft in a region facing the bottom face of the dam portion; and the paint supply port includes a paint supply tubular member and at least one nozzle hole, the at least one nozzle hole being formed in a wall of the paint supply tubular member that is parallel to the rotary shaft of the rotary atomizer head, and the at least one nozzle hole being configured to supply the paint in the radially outward direction.

2. The rotary atomizer head according to claim 1, wherein the dam portion is formed at an angle of incline to the inner peripheral face that is substantially equal to that of from the tip side of the inner peripheral face toward the bottom side of the inner peripheral face.

3. The rotary atomizer head according to claim 1, wherein:

the dam portion is constructed of an annular plate member in which a groove facing a center of the inner peripheral face is formed;

the plurality of the paint supply holes are formed through an outer peripheral end of the groove portion; and the dam portion is secured to the inner peripheral face.

4. The rotary atomizer head according to claim 3, wherein the annular plate member is formed as a two-piece structure, comprising:

an inner annular plate secured to the inner peripheral face;

an outer annular plate joined to the inner annular plate; and a spacer, formed at the outer peripheral end of the outer annular plate.

5. The rotary atomizer head according to claim 3, wherein an inner diameter of the annular plate member at a tip side thereof is larger than the inner diameter of the annular plate member on a bottom side thereof.

6. A rotary atomization painting method for spraying a paint using the rotary atomizer head according to claim 1.

7. The rotary atomizer head according to claim 1, wherein a cleaning hole that communicates with an outside of the atomizer head is formed through the region of the inner peripheral face opposite the dam portion.

8. The rotary atomizer head according to claim 1, wherein a face of the dam portion opposite the inner peripheral face is substantially parallel to the inner peripheral face.

9. A rotary atomization painting device comprising:

a rotary atomizer head comprising:

an inner peripheral face that increases in diameter from a bottom toward a tip thereof, and a paint supply port provided through the bottom of the inner peripheral face to supply paint, the paint supply port being configured to supply paint in a radially outward direction directly to the bottom of the inner peripheral face, wherein:

the paint supplied from the paint supply port to the bottom of the inner peripheral face is directed to flow toward the tip along the inner peripheral face due to a centrifugal force, and is thereby atomized and discharged from the tip of the inner peripheral face;

a dam portion is formed between the bottom of the inner peripheral face and the tip of the inner peripheral face, wherein the dam portion is annularly formed along a circumference of the inner peripheral face and has a plurality of paint supply holes formed therethrough near a boundary between the dam portion and the inner peripheral face;

a region of the inner peripheral face opposite the dam portion and a face of the dam portion opposite the inner peripheral face are separated from each other by a predetermined distance, defining a space configured to store paint, the space being in flow communication with the paint supply port and the plurality of paint supply holes;

the face of the dam portion is formed perpendicular to a rotary shaft of the rotary atomizer head;

the region of the inner peripheral face is convexly curved from the bottom toward the tip thereof so that the region of the inner peripheral face extends perpendicular to the rotary shaft in a region facing the bottom face of the dam portion; and the paint supply port includes a paint supply tubular member and at least one nozzle hole, the at least one nozzle hole being formed in a wall of the paint supply tubular member that is parallel to the rotary shaft of the rotary atomizer head, and the at least one nozzle hole being configured to supply the paint in the radially outward direction.

* * * * *